United States Patent [19]

Bodenhamer

[11] Patent Number: 4,775,982

[45] Date of Patent: Oct. 4, 1988

[54] CRUCIBLE FOR ELECTRIC ARC FURNACE

[76] Inventor: Robert L. Bodenhamer, 3500 Central Ave., Apartment 5-C, Charlotte, N.C. 28205

[21] Appl. No.: 84,813

[22] Filed: Aug. 13, 1987

Related U.S. Application Data

[63] Continuation-in-part of Ser. No. 883,390, Jul. 8, 1986.

[51] Int. Cl.[4] ..... H05B 7/00

[52] U.S. Cl. ..... 373/72

[58] Field of Search ..... 373/45, 72, 108

[56] References Cited

U.S. PATENT DOCUMENTS

| | | | |
|---|---|---|---|
| 2,987,788 | 6/1961 | Lyman | 373/72 X |
| 3,139,654 | 7/1964 | Harris | 373/72 X |
| 4,618,963 | 10/1986 | Rappinger et al. | 373/72 |

*Primary Examiner*—Roy N. Envall, Jr.

*Attorney, Agent, or Firm*—Clifton Ted Hunt

[57] ABSTRACT

A semiconductive crucible is provided for use in an electric arc furnace. The semiconductive crucible diverts and diffuses the protons around the anode before completing the electric circuit to form an arc, and thereby reduces the risk of a wayward arc reaching and scarring the wall of the mold.

14 Claims, 2 Drawing Sheets

CRUCIBLE FOR ELECTRIC ARC FURNACE

CROSS REFERENCE TO RELATED APPLICATION

This application is a continuation-in-part of my prior application Ser. No. 883,390, filed July 8, 1986 for COPPER CRUCIBLE.

FIELD OF THE INVENTION

This invention relates to a crucible or mold of the type used in electric arc melting furnaces to melt a sample of refractory metal to form a sample button or ingot for X-ray and optical emission spectrography to determine the content of the sample.

BACKGROUND OF THE INVENTION

The crucible or mold used in arc melting furnaces is generally fabricated of copper or other material of similar high thermal conductivity for utilization of the electric-arc techniques to obtain the high melting temperatures required in forming ingots of refractory metals and alloys.

In the usual crucible or mold construction, an inner wall of copper defines the mold wall and, with an outer shell spaced from the copper inner wall, defines a cooling jacket through which flows a cooling fluid such as water or a glycerol solution to cool the mold during the normal course of furnace operation.

The necessary high temperature for melting refractory metals and alloys is provided by an electric arc struck between an anode and the surface of the sample to be melted in the crucible. An electric circuit is completed to form the arc by a positive charge of electricity delivered through the copper barrel of the crucible.

Reference is made throughout the specification amd claims to the use of copper in a crucible. As used in this context, the word "copper" includes all other metals and alloys used to make crucibles for electric arc furnaces.

The term "sample", as used herein, means the confirmation of the content of elements in a specified quantity of metals and alloys.

The arcing between the anode and the refractory sample in the copper crucible is necessary to melt the sample, but the high electrical conductivity of the prior art all-copper crucible rushes the protons toward the neutrons in the anode along the most direct, but indeterminate, path of least resistance. The result is frequent uncontrolled wayward arcing that breaks away fragments of the copper mold wall which undesirably become a part of the sample ingot. The copper fragments from the cavity wall mix with the sample ingot and prevent an accurate analysis because the sample ingot contains more copper than the mass of metal supposedly represented by the sample.

The scarring of the mold wall by wayward arcing is sometimes so frequent and severe as to shorten the useful life of the crucible. It has been known to replace crucibles two or three times a week at a cost of about $350.00 per crucible.

U.S. Pat. No. 3,078,529 issued Feb. 26, 1963 to Cooper, et al for MELTING CRUCIBLE AND COOLING MEANS THEREFORE illustrates one effort to solve the problem of damage from wayward arcing in an arc melting furnace. Cooper, et al uses a liquid metal cooling medium in place of the usual water employed in the cooling jacket of crucibles for arc melting. Use of water in the cooling jacket of crucibles of the cold mold type had been found objectionable because wayward arcing in the crucible occasionally breaks the mold wall and allows water from the cooling jacket to enter the crucible. Contact of water with a molten refractory sample can result in disastrous explosion. The explosion hazard is eliminated when water is replaced by liquid metal as the cooling medium, according to the invention of Cooper, et al.

U.S. Pat. No. 2,761,002 issued Aug. 28, 1956 to Laird, et al for SAFETY MOLD CHAMBER FOR ARC MELTING FURNACES provides an intermediate layer of gas maintained under pressure between the copper crucible and the cooling jacket. As an additional safety feature Laird, et al provides an arc-extinguishing relay which is activated when a wayward arc would damage the copper wall of the crucible.

These prior art attempts to solve the problem of crucible damage by wayward arcing accept wayward arcing as an inherent risk in the operation of electric arc furnaces and seek to minimize the effect by immunizing the mold wall or controlling the extent of the damage rather than seeking to control the cause of wayward arcing and thereby reduce the risk of mold damage.

The conventional copper mold is largely straight-walled with an inward taper near its lower end terminating in a flat bottom wall extending perpendicular to the side wall of the mold. This configuration has the disadvantage of sometimes trapping the sample after it cools, making it difficult to remove the sample from the mold.

SUMMARY OF THE INVENTION

According to the invention, a semiconductive flange replaces the conventional highly conductive copper flange at the top of the copper crucible. As used herein, the term "semiconductive" means a homogenous mixture of copper and other elements that carry an electric charge with greater resistance than copper.

The positive charge of an electric circuit is connected to the semiconductive flange, which offers resistance and becomes heated. The heated area diffuses and disseminates the protons so they do not travel in a straight line betwen the terminal and the crucible. The relatively controlled dissemination of the protons in the semiconductive flange causes a more gradual approach of the protons toward the crucible resulting in a more controllable arc and less risk of damage to the mold wall.

It is an object of this invention to provide a measure of control over the arc in an electric arc melting furnace and thereby reduce the risk of damage to the mold wall and contamination of the sample ingot heretofore caused by wayward arcing during formation of the sample.

The approach to the problem is that reducing wayward arcing will reduce the risk of damage to to the crucible.

Another object of the invention is to provide a crucible having a mold configuration facilitating the formation of ingots or "buttons" in the bottom of the mold and facilitating the removal of the ingot or button from the mold. The formation of the button is facilitated by providing a plurality of vertically spaced inwardly inclined steps directing the molten sample inwardly toward the bottom wall of the mold spaced beneath the lower step. The bottom wall tapers downwardly toward the center of the crucible from the circular side wall and the juncture of the bottom wall with the side wall of the mold is rounded so the molten sample is rolled toward the center of the mold as it melts. The sample ingot pulls away from the side wall as it cools and is easily removed from the mold.

DETAILED DESCRIPTION OF THE INVENTION

THE ELECTRIC ARC FURNACE

Figure 1:
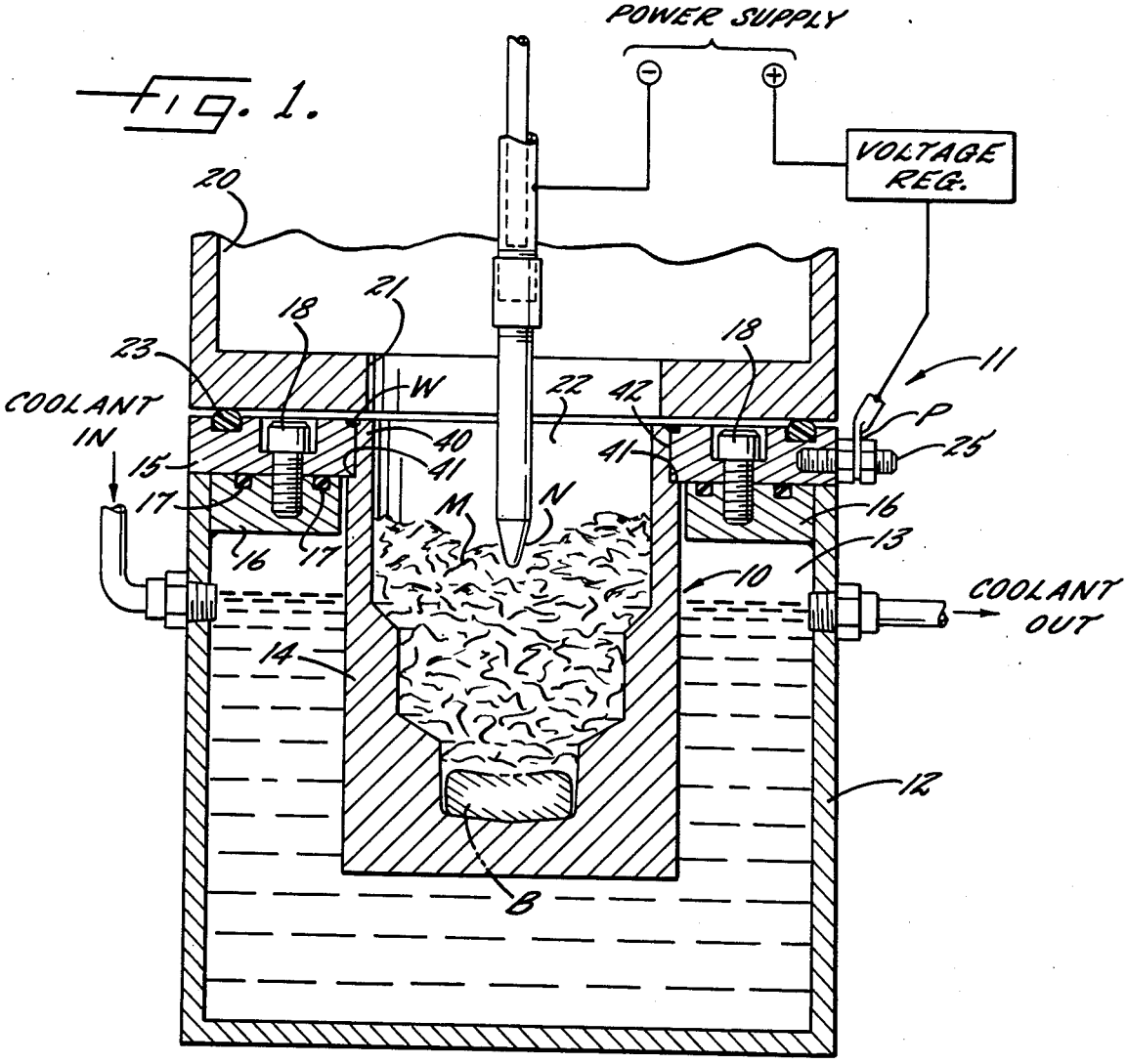
FIG. 1 is a sectional view through an electric arc melting furnace showing a crucible of the present invention.

Referring more specifically to the drawings, a semiconductive crucible, broadly indicated at 10, is shown as part of an electric arc furnace broadly indicated at 11 in FIG. 1. The electric arc furnace 11 also includes an outer shell 12 spaced outwardly from the crucible 10 and defining a cooling jacket 13 between the crucible 10 and the outer shell 12. The cooling jacket 13 contains a pressurized stream of a suitable coolant such as water or, preferably, a mixture of water and ethylene glycol. A 50—50 ratio of ethylene glycol with distilled water flowing under 100 to 150 psi is preferred for enhanced cooling, although satisfactory results have been obtained by using plain water as the cooling agent.

The crucible 10 includes a body portion or mold 14 formed from rolled high density copper or other refractory alloy of high thermal conductance. A semiconductive flange 15 extends about the top of the mold 14 and is seated on a flange 16 extending inwardly from the top of the cooling jacket 13. O-rings 17 provide a satisfactory seal between the flanges 15 and 16 when the flange 15 is attached to the flange 16 by bolts 18.

The arc melting furnace also includes a vacuum chamber 20 supported on the cooling jacket 13 and having a medial opening 21 communicating with a cavity 22 in the mold 14. O-rings 23 provide a satisfactory seal between the vacuum chamber 20 and the cooling jacket 13.

A negatively charged anode N extends through the vacuum chamber and into the cavity 22 of the mold 14. A positive electric charge is delivered to the semiconductive flange 15 of the crucible 10 as by a terminal P connected to a threaded rod 25 extending from the flange 15 as shown in FIG. 1.

The cooling jacket 13, vacuum chamber 20, anode N, and terminal P are conventional parts of an electric arc furnace and well known to those skilled in the art. It is with an electric arc furnace of this nature that the semiconductive crucible of this invention is intended to be used and this brief description of the components of the furnace has been provided as background for an understanding of the semiconductive crucible.

THE PRIOR ART ALL-COPPER CRUCIBLE

Figure 2:
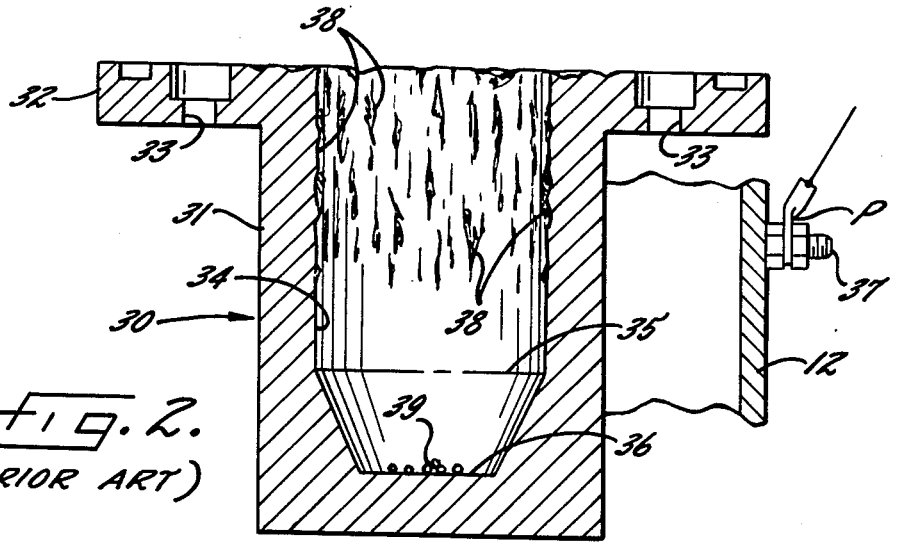
Fig. 2. (PRIOR ART)
FIG. 2 is a fragmentary sectional view through a prior art crucible and cooling jacket, with parts broken away, and illustrating the appearance of a crucible damaged by wayward arcing.

Electric arc furnaces conventionally use all-copper crucibles such as generally indicated at 30 in FIG. 2. The prior art crucible 30 comprises a copper body portion or mold 31 and an integral flange 32 formed of the same copper. The prior art copper crucible 30 is positioned and utilized in the electric arc furnace 11 in the same manner as previously described for the crucible 10 except that the terminal P is attached to a rod 37 extending from the cooling jacket 13 instead of the copper flange 32. The flange 32 is supported by and secured to the flange 16 of the cooling jacket by the bolts 18 penetrating openings 33 through the flange 32 and threadably engaged with the flange 16 of the cooling jacket.

The prior art crucible 30 of FIG. 2 has a straight walled cavity 34 which tapers inwardly as at 35 and terminates in a perpendicularly extending flat bottom wall 36. The cavity 34 of the prior art mold 30 shown in FIG. 2 illustrates the condition of the cavity wall after it has been subjected to the wayward arcing inherent in use of the prior art crucible 30 to obtain sample buttons or ingots. The initially straight walls of the cavity have been badly scarred as indicated at 38 to disfigure the side walls and dislodge particles of copper which mix with and contaminate the specimen button being formed at the time. An accumulation of such dislodged copper fragments is indicated at 39 on the bottom wall of the mold for the purpose of illustration.

The scarred condition of the mold 30 and the consequent breaking away of particles of copper from the sides of the prior art mold of FIG. 2 render the mold unusable. Replacement of prior art molds is sometimes necessary after one or two days operation. Frequent replacement of all-copper crucibles in electric arc furnaces is accepted as a necessary part of the business by those skilled in the art of making specimen buttons and not familiar with the present invention.

THE CAUSE OF MOLD SCARRING

The wayward scar-causing arcing between the anode N and the wall of the cavity 34 in the prior art all-copper crucible 30 is caused by the rush of protons along an indeterminate path through the copper crucible from the positively charged terminal P on the cooling jacket to the neutrons in the negatively charged anode N in the crucible.

By way of explanation, all forces move along the path of least resistance within an electric field. The protons emanating from the positive charge in an electric field are about 1,800 times more massive than the neutrons emanating from the negative charge within that field. The negatively charged neutrons move toward the positively charged protons and the protons rush along the path of least resistance toward the neutrons.

Copper is an excellent conductor of electricity, although the path of least resistance through copper is both unpredictable and uncontrollable. That path is determined by the random disposition of the conductive elements in copper. If the path, because of the disposition of the conductive elements, is direct instead of circuitous, there is likely to be violent and wayward arcing against the mold wall while forming the sample with high risk of damage to the mold wall and contamination of the sample. If the path, because of the disposition of the conductive elements in the copper, is circuitous instead of direct, there is less likelihood of wayward arcing during the formation of the sample with less risk of damage to the mold wall and contamination of the sample.

It is important to an understanding of the present invention to recognize that it is the lack of control over the unpredictable route of the protons as they follow the path of least resistance from the terminal P to the anode N that causes wayward arcing and costly scarring of the mold.

THE PREVENTION OF MOLD SCARRING

It has been found that satisfactory but less wayward arcing can be obtained by diffusing the protons and insuring that the protons do not move along a direct path between the terminal P and the anode N, as frequently happens in the prior art crucible.

According to the invention, the protons are diverted from the possibility of a direct path to the anode by directing them through a semiconductive flange which offers resistance and generates heat which desseminates the protons circumferentially along the flange and throughout the 360° radius of the copper mold or body portion 31 before they are allowed to proceed to the anode.

The copper flange 32 formed integrally with the copper mold body 31 of the prior art all-copper crucible 30 is replaced with a less conductive or semiconductive flange made from, for example, bronze. Bronze is an alloy of copper with less conductive elements such as lead, tin, zinc, and nickel, and is not as good a conductor of electricity a copper.

The electrical conductivity and melting points of the elements in bronze are shown in the following table:

| | THERMAL CONDUCTANCE | |
|---|---|---|
| ELEMENT | CONDUCTIVITY | MELTING POINT |
| Copper | 94% | 1,083 degrees C. |
| Zinc | 27% | 419.6 degrees C. |
| Nickel | 19.8% | 1,453 degrees C. |
| Tin | 16% | 231.9 degrees C. |
| Lead | 8.3% | 327.43 degrees C. |

A semiconductive flange, such as bronze, between the positive terminal P and the copper mold body 14 generates heat and reduces the voltage when subjected to an electrical charge. The heat creates successive barriers to a direct path by successively diverting the protons and the reduced voltage circumferentially to cooler areas in the semiconductive flange en route to the copper crucible before proceeding through the sample alloy to the anode.

Different compositions of bronze, providing different values of semiconductivity, should be used for melting different samples. One composition of bronze that has been successfully used in melting tungsten, for example, is the following SAE 660 composition:

| SAE 660 COMPOSITION OF BRONZE | |
|---|---|
| Copper | 83% |
| Lead | 7% |
| Tin | 7% |
| Zinc | 3% |

The elements are homogenously mixed and the irregularities of conductivity of the elements within the bronze and the heat generated by the resistance of the less conductive elements divert and diffuse the protons within the bronze flange 15 and require the protons to flow circumferentially through cooler parts of the semiconductive flange and enter the neck 40 of the copper crucible 14 along an arc extending at least partially along the 360° juncture of the semiconductive flange 15 with the conductive copper mold 14. The pressurized liquid in the cooling chamber constantly carries away heat and cools the surfaces of the semiconductive flange and the copper crucible and therby create the path of least resistance which causes the protons in the reduced voltage circumnavigate the copper mold before flowing through the sample alloy to be melted by arcing with the anode.

The reduction of voltage and the causing of the protons to approach the crucible along an arcuate path results in a less wayward arc and less spattering of the arc against the wall of the mold cavity 22. The consequence, of course, is less scarring of the cavity wall, more sample buttons without copper contamination, and a longer useful life for the crucible.

Figure 3:
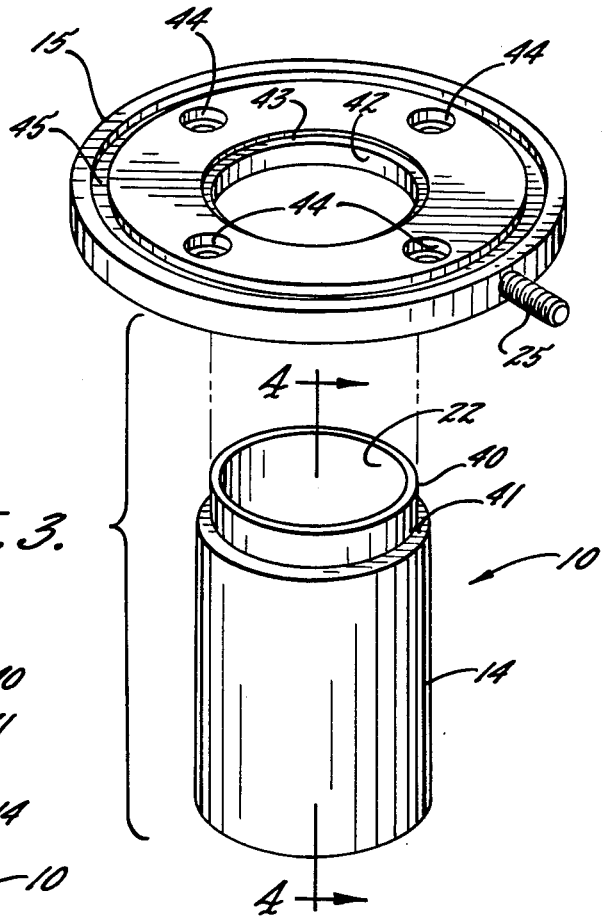
FIG. 3 is an exploded perspective view of the semiconductive crucible of this invention.

In the illustrated embodiment of the invention, the semiconductive flange 15 is mounted on the copper mold 14 of the crucible 10 (FIG. 3) by reducing the wall thickness of the mold at its upper end to define a reduced neck 40 and a shoulder 41. The flange 15 has an opening 42 therethrough which snugly receives the neck 40. The copper neck 40 serves as a conduit to direct the protons completely around the copper crucible before they enter the sample alloy and arc agaisnt the anode. A shoulder 43 is defined about the opening 42 to support a weld bead of silver indicated at W in FIG. 1, uniting the flange 15 to the crucible body 14.

The flange 15 has openings 44 spaced radially outwardly from the central opening 42 to receive the bolts 18 connecting the crucible to the cooling jacket 13 as in FIG. 1. A seat 45 (FIG. 3) supports the O-ring 23 between the flange 15 and vacuum chamber 20 in FIG. 1.

THE IMPROVED MOLD CAVITY

The top of the cavity 22 in the crucible 10 is $\frac{3}{8}$ of an inch larger than the inside diameter of the cavity 34 in the prior art crucible 30 of FIG. 2. The increased diameter reduces the risk of the arc reaching and scarring the wall of the cavity.

Figure 4:
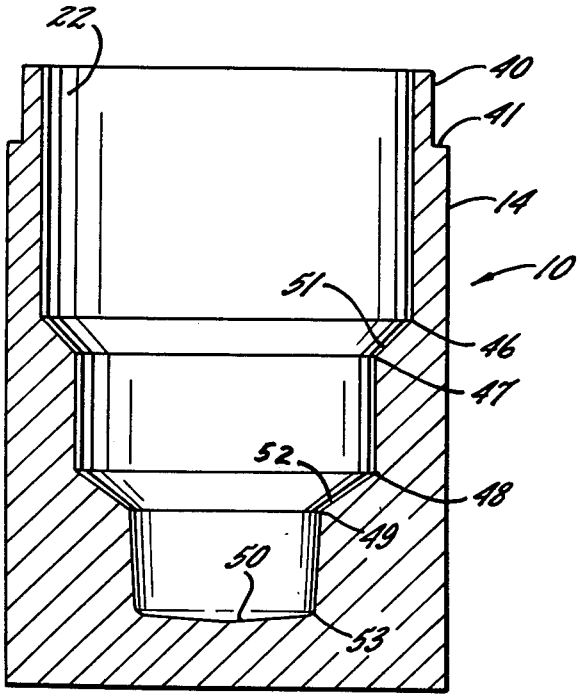
FIG. 4 is a sectional view taken substantially along the line 4—4 in 3.

The wall of the cavity 22 extends straight down from the reduced neck 40 almost half the length of the mold to a point 46 where it tapers inwardly at about a 45° angle a short distance to a point 47. The wall of the cavity 22 extends vertically downwardly in FIG. 4 from the point 47 to a point 48 where it again extends inwardly at about a 45° angle for a short distance to a point 49, and then vertically downwardly to the bottom wall 50. The inwardly inclined portions of the cavity wall between the points 46,47 and 48,49 define respective steps 51 and 52 which function to funnel the molten sample M toward the bottom wall 50.

Figure 5:
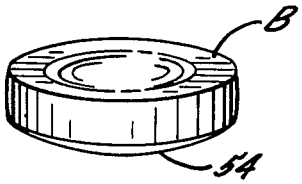
FIG. 5 is a perspective view of a button or ingot removed from the mold.

The juncture of the bottom wall 50 with the vertical side wall of the cavity 22 has a radius 53 measuring about 3/32. The bottom wall 50 tapers inwardly from the rounded juncture 53 at about a 0.5° taper toward the center of the mold. The tapered bottom 50 and the rounded juncture 53 of the bottom with the side wall roll the molten sample so that, when cooled, the sample shrinks from the side wall of the cavity as shown in phantom lines in FIG. 1. The button is then easily removed from the mold. The button B is illustrated in FIG. 5, removed from the mold, and it will be noted that the button B has a rounded bottom 54 generally conforming with the configuration of the bottom wall 50 of the mold.

There is thus provided a semiconductive crucible for use in melting refractory metals and alloys in an electric arc furnace, the semiconductive crucible having the advantages of (1) reducing the scarring of the cavity wall and thereby contributing to the longevity and economy of the mold, while improving the integrity and purity of the sample button, and (2) releasing the button from the mold.

Although specific terms have been used in describing the invention, they are used in a descriptive and generic sense only and not for the purpose of limitation.

I claim:

1. In an electric arc melting furnace having a highly conductive mold body with a cavity for the reception of a sample to be molten into a button at the bottom of the mold, an anode, means supporting the anode within the cavity of the mold, a terminal connected to the mold and means for delivering an electric current to the mold body with a negative charge at the anode and a positive charge at the terminal, the combination of a semiconductive flange between the terminal and the anode, whereby the protons in the positive charge disseminate around the anode and approach the anode from more than one direction to complete the circuit and form an arc.

2. Apparatus according to claim 1 wherein the protons approach the anode from all directions to complete the circuit and form an arc.

3. Apparatus according to claim 1 wherein the terminal is connected directly to the semiconductive flange.

4. Apparatus according to claim 1 wherein the semiconductive flange is formed of bronze.

5. Apparatus according to claim 4 wherein the bronze flange is an SAE 660 composition of 83% copper, 7% lead, 7% tin, and 3% zinc.

6. Apparatus according to claim 1 wherein the cavity in the mold body is defined by a side wall including at least one inwardly tapered step and a bottom wall extending at an obtuse angle from the side wall, whereby the button shrinks from the side wall as it cools.

7. A semiconductive crucible for use in an electric arc furnace for melting refractory metals and alloys to form a sample, said crucible comprising a copper mold and a semiconductive flange connected to a source of electrical energy, whereby protons meet resistance as they flow through said semiconductive flange and approach said copper mold from more than one direction.

8. A semiconductive crucible according to claim 7 wherein the semiconductive flange is a composition of copper, lead, tin, and zinc.

9. A semiconductive crucible according to claim 8 which includes nickel.

10. A crucible for use in an electric arc furnace for melting refractory metals and alloys to form a sample, said crucible comprising a copper mold body having a circular cavity, the side wall of the cavity being generally vertical in use and including at least one inwardly and downwardly inclined step, and a bottom wall extending inwardly and downwardly from the side wall beneath the step.

11. A crucible according to claim 10 wherein the juncture of the bottom wall and the side wall is rounded.

12. A method of completing an electric circuit between a negatively charged anode and a positively charged copper mold in an electric arc furnace, said method comprising the steps of providing a semiconductive flange around the copper mold, connecting a positive charge of electricity to the semiconductive flange, and connecting the semiconductive flange to the copper mold with a highly conductive bonding agent whereby protons meet resistance as they flow through said semiconductive flange and approach said copper mold from more than one direction.

13. A method according to claim 12 wherein the highly conductive bonding agent is silver solder.

14. In an electric arc melting furnace having a highly coductive mold body with a cavity for the reception of a sample to be molten into a button at the bottom of the mold, an anode, means supporting the anode within the cavity of the mold, and means for delivering an electric current to the mold body, the combination of said means for delivering an electric current to the mold body including a terminal and semiconductive flange connected between the terminal and the mold body whereby the path of the protons is diffused through said semiconductive flange to the highly conductive mold body.

* * * * *